US005848343A

United States Patent [19]

Takahashi et al.

[11] Patent Number: 5,848,343

[45] Date of Patent: Dec. 8, 1998

[54] ELECTROPHOTOGRAPHIC IMAGE-FORMING APPARATUS WITH UNIFORM TONER USAGE CONTROL

[75] Inventors: Takefumi Takahashi, Kawasaki; Shizuo Takano, Inagi; Yoshio Yamaguchi, Kawasaki; Hiroshi Kera, Kawasaki; Akira Nagahara, Kawasaki; Yoshiya Ishiyama, Kawasaki; Hideki Kamaji, Kawasaki; Toshio Tooda, Kawasaki, all of Japan

[73] Assignee: Fujitsu Limited, Kawasaki, Japan

[21] Appl. No.: 886,416

[22] Filed: Jul. 1, 1997

[30] Foreign Application Priority Data

Dec. 20, 1996 [JP] Japan ..... 8-342119

[51] Int. Cl.[6] ..... G03G 21/10; G03G 15/10

[52] U.S. Cl. ..... 399/359; 399/58

[58] Field of Search ..... 399/359, 49, 72, 399/29, 58

[56] References Cited

U.S. PATENT DOCUMENTS 4,980,723 12/1990 Buddendeck et al. ..... 399/72

5,122,835 6/1992 Rushing et al. ..... 399/49

5,526,100 6/1996 Misago et al. ..... 399/29

FOREIGN PATENT DOCUMENTS 7-114259 5/1995 Japan .

*Primary Examiner*—S. Lee

*Attorney, Agent, or Firm*—Armstrong, Westerman, Hattori, McLeland, & Naughton

[57] ABSTRACT

An electrophotographic image forming apparatus includes an electrostatic latent image carrying body, an electrifying unit for electrifying the image carrying body, a light irradiating unit to form an electrostatic latent image in accordance to image information, a developing unit for discharging toner to the image carrying body to develop the latent image, a transfer unit for transferring the toner image to a recording sheet, and a cleaner for removing residual toner on the image carrying body. The toner removed from the image carrying body is recirculated to the developer receiving box. An additional toner image is formed on a position other than a first position where the electrostatic latent image is formed in accordance with the image information. The toner is removed by the cleaner without being transferred to the recording sheet and recirculated from the image carrying body to the developer receiving box.

17 Claims, 10 Drawing Sheets

ELECTROPHOTOGRAPHIC IMAGE-FORMING APPARATUS WITH UNIFORM TONER USAGE CONTROL

BACKGROUND OF THE INVENTION

1. Field of the Invention

The present invention relates to an electrophotographic image-forming apparatus such as a copying machine, a facsimile or any other laser printer.

2. Description of the Related Art

Due to the recent developments in office automation, electrophotographic image-forming apparatuses, such as a laser beam printers, are being widely used in computer output terminals, in copying machines, in facsimile machines or in other printing machines.

In such an image-forming apparatus, a hard copy is obtained by the steps of charging a photoconductor drum at a predetermined potential by an electric charger, forming an electrostatic latent image corresponding to an image information on the photoconductor drum by irradiating light thereto, developing the latent image with a powder, i.e., toner, to a visible image. After transferring the developed image to a recording medium, the recording medium is separated from the photoconductor drum and the developed image is fixed on the recording medium.

Later, the photoconductor drum is discharged by a discharger, and the residual toner is scraped off from the surface of the photoconductor drum by a cleaner, thus one cycle of the printing operation is completed on the photoconductor drum.

As a method for developing the electrostatic latent image on the photoconductor drum, there is a "two-component" type developing method, in which a developer containing carrier and toner is used particularly for high speed printers. Around the developing magnet roller for supplying the developer to the photoconductor drum, there is provided a developer receiving box for temporarily storing the developer therein and the amount of carrier is predetermined with respect to the capacity of the developer receiving box so as to control the toner density (rate of application) so that a volume of toner having a certain density is equal to the capacity of the developer receiving box. Such a method has the following advantages.

(1) The developer which is continuously supplied up to the life of apparatus is only the toner and, therefore, it is not necessary to supply carrier during the service life of the printer. Therefore, the running cost of the apparatus can be reduced.

(2) The density of toner can be mechanically controlled and, therefore, a toner density sensor can be eliminated.

If a system in which the residual toner on the latent image carrying body (photoconductor drum) is collected during the transferring process and used again in the development device is employed, the running cost of the apparatus can further be reduced.

However, in the conventional electrophotographic image forming apparatus, there are following problems. If a system in which the density of toner (weight ratio) is controlled is employed, due to the characteristic of toner density control, the flow of developer in the axial direction of the apparatus, i.e., perpendicular to the feeding direction of the recording medium, is not activated. Therefore, if a printing operation is repeated for a large number of printing sheets and if a printing pattern for the respective printing sheet has a relatively large deviation in the axial direction, there are a large deviation in the toner consumption rate in the axial direction. Thus, there exists one portion where toner is always consumed and therefore, a fresh toner is always supplied and the other portion where toner is scarcely consumed and therefore the stationary toner resides on the sleeve of the developing magnet roller and the developer receiving box.

The residual toner on the sleeve of the developing magnet roller and the developer receiving box is subjected to a reduction of electric potential, a mechanical destruction, removal of the carrier, a deviation of toner density, or the other problems. The print on the recording medium may be blurred or striped or ODs (off-dots) may be generated.

SUMMARY OF THE INVENTION

An object of the present invention is to provide an electrophotographic image forming apparatus in which the deviation in the characteristic of toner in the axial direction of the apparatus is reduced as much as possible to obtain a high printing quality without any blur, stripes or ODs.

Another object of the present invention is to provide an electrophotographic image forming apparatus having a developing apparatus in which the above-mentioned drawbacks can be overcome.

According to the present invention, there is provided an electrophotographic image forming apparatus comprising: an electrostatic latent image carrying body; an electrifying means for electrifying the image carrying body; means for irradiating light onto the image carrying body to form an electrostatic latent image thereon in accordance to image information; a developing unit, including a developing roller and a developer receiving box, for discharging toner to the image carrying body so as to develop the latent image and to form a toner image thereon; a transfer unit for transferring the toner image from the image carrying body to a recording medium; means for conveying the recording medium through the transfer unit; and a cleaning means for removing residual toner from the image carrying body; means for recirculating the toner removed from the image carrying body by the cleaning means to the developer receiving box;

the apparatus further comprising a toner discharge unification means comprising means for discharging toner by the developing roller to a second portion on the image carrying body other than a first portion where the electrostatic latent image is formed in accordance with the image information, so as to develop the toner on the image carrying body, so that the toner is removed by the cleaning means without being transferred to the recording medium and recirculated from the image carrying body to the developer receiving box.

The recording medium is a cut sheet and the second portion corresponds to a non-transfer area which is defined between adjacent the cut sheets, so that, after a certain number of cut sheets are printed, the toner discharge unification means discharges toner by the developing roller at the non-transfer area on the image carrying body.

The toner discharge by the developing roller to the image carrying body is performed uniformly by a certain amount in a direction perpendicular to the conveying direction of the recording medium.

The toner discharge by the developing roller to the image carrying body is performed in such a manner that a total amount of toner, including the toner discharged in accordance with the image information, is substantially constant both in a recording medium conveying direction and in a direction perpendicular thereto.

A printing area on the image carrying body is divided into several sections having the same width in a direction perpendicular to a recording medium conveying direction and the toner discharge by the developing roller to the image carrying body is performed in such a manner that print dot numbers of the respective sections are counted in accordance with the image information and an amount of toner, which is to be discharged, is determined for the respective sections in accordance with the print dot numbers.

A printing area on the image carrying body is divided into several sections having the same width in a direction perpendicular to a recording medium conveying direction and the toner discharge by the developing roller to the image carrying body is performed in such a manner that a toner having same pattern is developed in the respective sections along the recording medium conveying direction.

A printing area on the image carrying body is divided into several sections having the same width in a direction perpendicular to a recording medium conveying direction and the toner discharge by the developing roller to the image carrying body is performed in such a manner that print dot numbers of the respective sections are counted in accordance with the image information and a toner having same pattern, but having a length in accordance with the print dot number, is developed in the respective sections.

A printing area on the image carrying body is divided into several sections having the same width in a direction perpendicular to a recording medium conveying direction and the toner discharge by the developing roller to the image carrying body is performed in such a manner that print dot numbers of the respective sections are counted in accordance with the image information and a toner having different printing rate in accordance with the print dot number, is developed in the respective sections.

An amount of toner, which is to be discharged, is determined for the respective sections in accordance with the print dot numbers.

According to another aspect of the present invention, there is provided an electrophotographic image forming apparatus comprising: an electrostatic latent image carrying body; an electrifying means for electrifying the image carrying body; means for irradiating light onto the image carrying body to form a first electrostatic latent image thereon in accordance with first image information; means for irradiating light onto the image carrying body to form a second electrostatic latent image thereon in accordance with second image information; a developing unit, including a developing roller and a developer receiving box, for discharging toner to the image carrying body so as to develop the first and second latent images and to form first and second toner images thereon; a transfer unit for transferring the first toner image from the image carrying body to a recording medium; means for conveying the recording medium through the transfer unit; a cleaning means for removing residual toner of the first toner image and toner of the second toner image from the image carrying body; means for recirculating the toner removed from the image carrying body by the cleaning means to the developer receiving box; and means for controlling, not to transfer the second toner image to the recording medium, but to form the second toner image on a position on the image carrying body corresponding to a non-transfer area or an area defined between adjacent the recording mediums.

BRIEF DESCRIPTION OF THE DRAWINGS

The present invention will be described in more detail with reference to the attached drawings illustrating the preferred embodiments; wherein.

DESCRIPTION OF THE PREFERRED EMBODIMENTS

Some preferred embodiments will now be described in detail with reference to the accompanying drawings.

Figure 1:
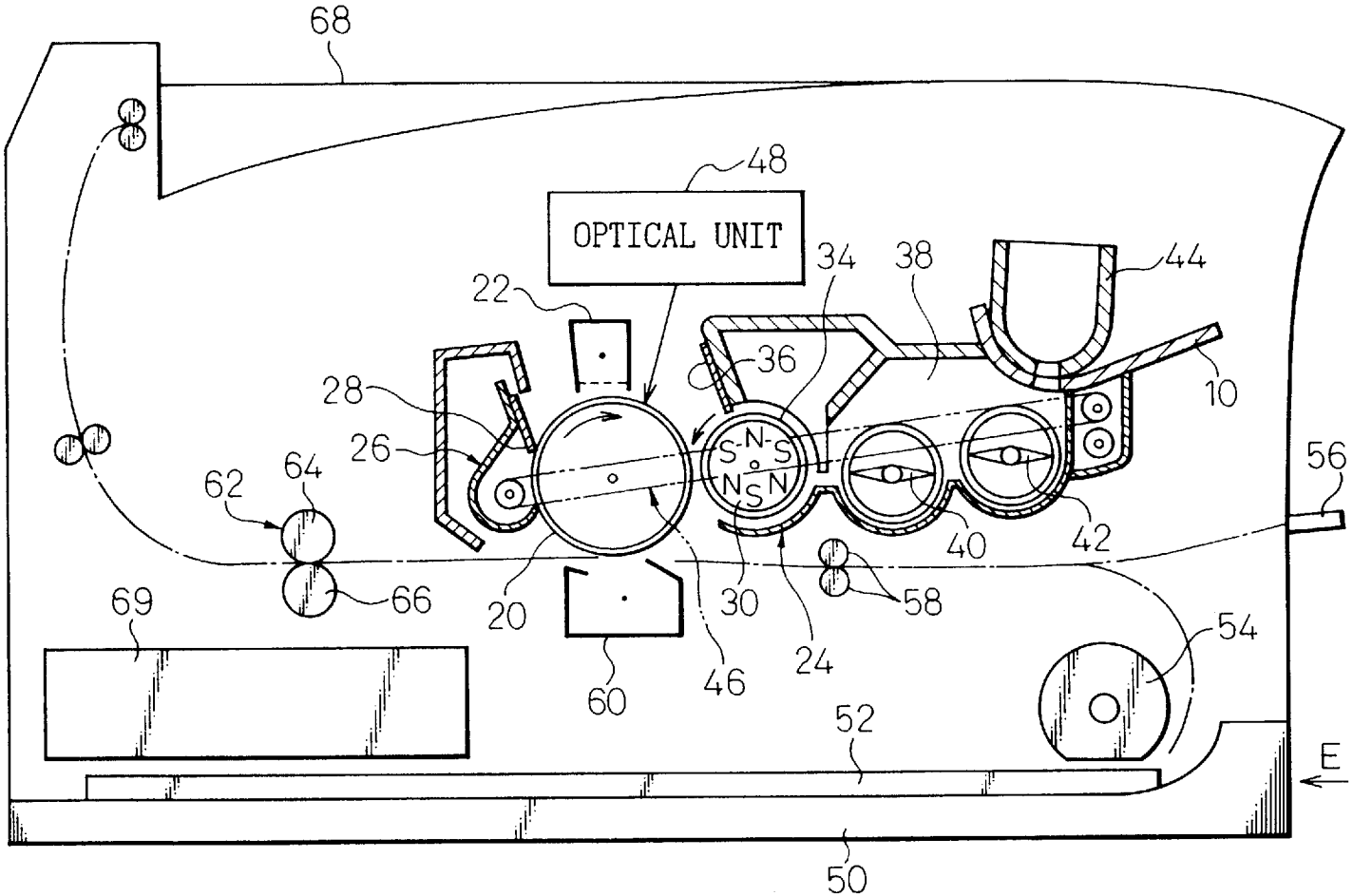
FIG. 1 is an illustration of an overall structure of a printer employing an electrophotographic apparatus according to the present invention.

In FIG. 1, a structure of an electrostatic photograph image forming apparatus (printer) according to the present invention is diagrammatically illustrated. An image carrier of the photoconductor drum 20 is formed by providing a double-layered photoconductor structure, 20 $\mu$m thick, on an aluminum drum of 24 mm diameter, and rotates in the arrowed direction at a peripheral speed of 25 mm/sec. The corona charger 22 is a scorotron charger capable of uniformly charging the surface of the photoconductor drum 20 to a potential of about −600V.

The optical unit 48 is operative to form an electrostatic latent image on the uniformly charged photocondutor drum 20 by the image exposure. According to this embodiment, a semiconductor laser unit is adopted as the optical unit 48. An electrostatic latent image as a potential in a range between −50V and −100V is formed on the photoconductor drum 20 by exposing the same in accordance with the image pattern.

The electrostatic latent image is developed by the development device 24 with the developer roller 30 to form a toner image on the photoconductor drum 20. The developer roller 30 is structured by a magnetic roller with a plurality of magnetic poles and a sleeve rotatable on the magnetic roller.

A toner supplied from the toner cartridge 44 and a residual toner recycled from the toner recycling mechanism 46 are supplied into the toner chamber 38, and the toners are uniformly mixed with each other by the rotation of the agitators 40 and 42.

The carrier chamber 34 accommodates a predetermined amount of carrier therein, and the toner is delivered from the toner chamber 38 into the carrier chamber 34 so that a toner density in the carrier chamber 34 is maintained generally constant.

A layer thickness of the developing agent on the developer roller 30 is controlled by the doctor blade 36 so that a magnetic brush is formed on the developer roller 30. When this magnetic brush touches the electrostatic latent image on the photoconductor drum 20, the latent image is developed to be a toner image.

A recording medium of paper 52 accommodated in a paper cassette 50 is taken out therefrom by the rotation of a pick roller 54 and conveyed to a transfer charger 60 after the timing thereof is adjusted to be matched with the toner image on the photoconductor drum 20. In this regard, a manual paper tray 56 is also provided.

The toner image on the photoconductor drum 20 is electrostatically transferred to the paper 52 by the operation of the transfer charger 60. The toner image transferred to the paper 52 is fixed by a fixing device 62 consisting of a heat roll 64 and a backup roll 66. Thereafter, the paper carrying the fixed image is discharged to a stacker 68.

The residual toner on the photoconductor drum 20 is scraped off therefrom by the blade 28 of the cleaner 26 and returned to the toner chamber 38 through the toner recycling mechanism 46. A printed circuit board 69 carries a control circuit for the printer thereon.

As the toner is consumed by the developing operation, the toner amount in the carrier chamber 34 reduces to minimize the volume of the developing agent consisting of a carrier and a toner. Then, an amount of the toner stored in the toner chamber 38, corresponding to the consumed amount, is replenished to the carrier chamber 34 by the rotation of the agitators 40 and 42 so that the toner density in the carrier chamber 34 is maintained constant. The agitators 40 and 42 correct the axial distribution of the toner in the toner chamber 38.

When the toner becomes low in the toner chamber 38 due to the exhaustion of the toner, this state is detected by a toner sensor (not shown) and is indicated on a display of the printer. Then, the operator removes the exhausted toner cartridge from the development device 24 and instead mounts a fresh toner cartridge 44 filled with the toner onto the development device 24 to replenish the toner in the toner chamber 38.

Figure 2:
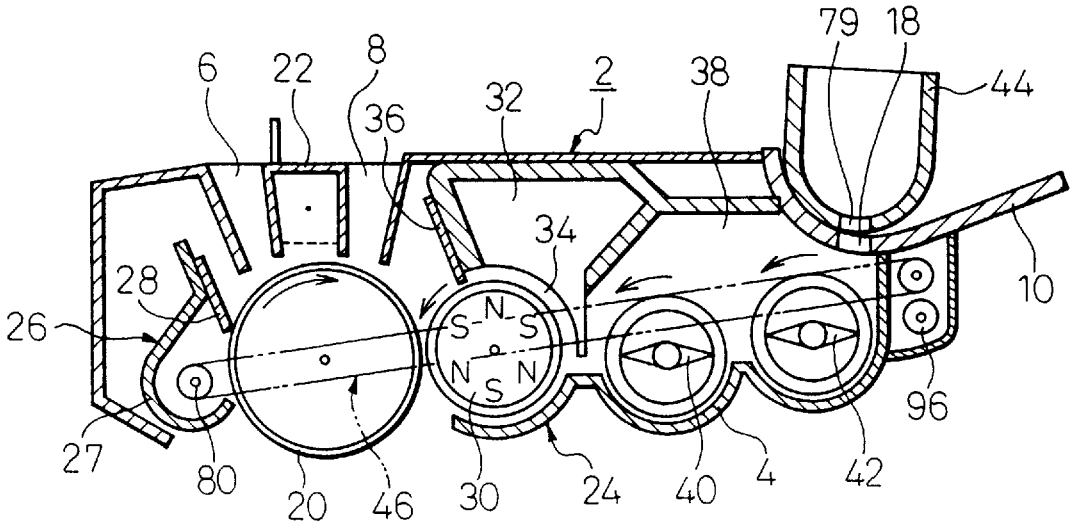
FIG. 2 is a schematic cross-sectional view of the developing process unit.

FIG. 2 illustrates a sectional view of a process unit according to one embodiment of the present invention. The process unit 2 is a structure wherein a photoconductor drum 20, a development device 24 and a cleaner 26 are combined in an integral manner, to be detachable as a single unit from a printer.

A housing 4 of the process unit 2 has an opening 6 for mounting a corona charger 22 and an opening 8 for exposing the photoconductor drum 20 by an optical unit. The corona charger 22 is mounted into the opening 6 of the housing 4 of the process unit 2.

The development device 24 includes a developer roller 30 rotatable in the arrowed direction and a carrier chamber or a development chamber 34 defined between the developer roller 30 and a partitioning member 32 attached to the housing 4. The carrier chamber 34 stores therein a developing agent consisting of a carrier and a toner. A doctor blade 36 is provided for controlling a thickness of a layer of the developing agent sticking to the developer roller 30.

A toner chamber 38 is provided, for storing the toner therein, in which are rotatably mounted first and second agitators 40, 42 for mixing the toner stored in the toner chamber 38.

The cartridge 44 is detachably mounted to the cartridge receiving member 10. The cleaner 26 has a blade 28 which is in contact with the photoconductor drum 20 to scrape off the residual toner therefrom.

A toner recycling mechanism 46 returns the residual toner stored in a housing 27 of the cleaner 26 to the toner chamber 38 of the development device 24.

Figure 3:
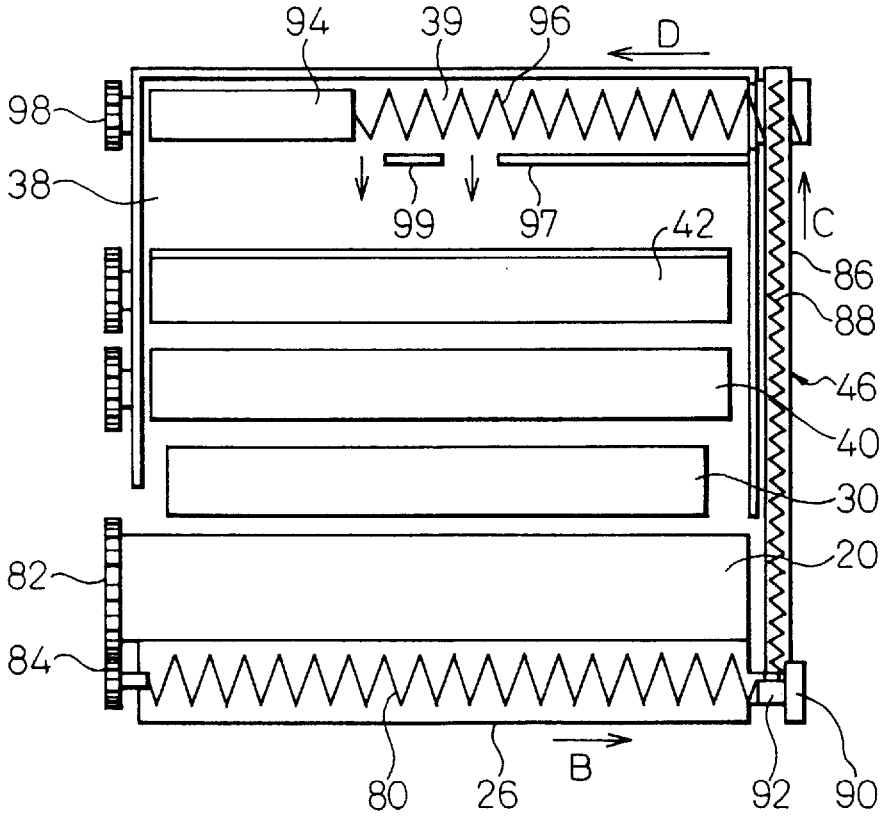
FIG. 3 is a plan view of the toner recirculation system.

Details of the toner recycling mechanism 46 will be described with reference to FIG. 3. A coil member 80 is accommodated in the cleaner 26 while being coupled to a gear 84 at one end and to a helical gear 90 at the other end.

The toner recycling mechanism 46 includes a flexible tube 86 such as a rubber hose 86 and a coil member 88 accommodated in the flexible tube 86. One end of the coil member 88 is coupled to a helical gear 92 meshed with the helical gear 90. In a toner returning chamber 39 adjacent to the toner chamber 38 are accommodated a shaft 94 coupled to a gear 98 and a coil member 96 coupled to the shaft 94.

When the gear 84, meshed with a gear 82 for driving the photoconductor drum 20, rotates, the coil member 80 also rotates to convey the residual toner in the cleaner 26 in the arrowed direction B. The rotation of the coil member 80 is transmitted to the coil member 88 accommodated in the flexible tube 86 via the gears 90 and 92 to rotate the coil member 88 so that the residual toner is conveyed in the arrowed direction C.

On the other hand, the coil member 96 rotates via the gear 98 to convey the residual toner collected in the toner returning chamber 39 in the arrowed direction D and supplies the same to the toner chamber 38 through openings 97 and 99 provided in a widthwise central zone of a back plate defining the toner chamber 38.

According to the toner recycling mechanism of this embodiment, since the residual toner accommodated in the cleaner 26 is returned to the widthwise central zone of the toner chamber 38, it is possible to uniformly mix the toner supplied from the toner cartridge 44, with the residual toner, by the rotation of the agitator 42.

As described above, during the continuous printing operation, the residual toner on the photoconductor drum is collected and will be used again.

Figure 4:
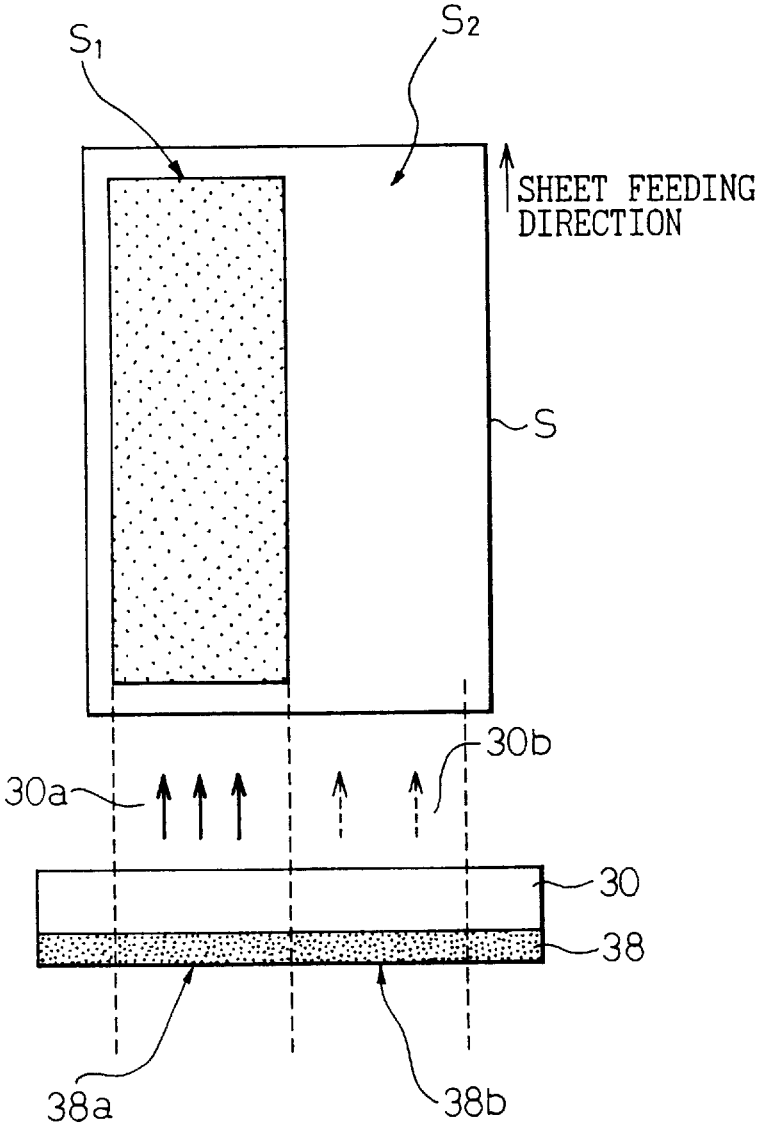
Fig. 4 PRIOR ART
FIG. 4 is a plan view showing the relationship in position between the printing pattern and the stationary toner in the conventional system.

FIG. 4 shows the relationship in positions between the print pattern and the stationary toner on the photoconductor drum. In FIG. 4, the left half portion $S_1$, in the printing area on the recording sheet S is an area of high rate of print and the right half portion S2 in the printing area is an area of low rate of print. Therefore, the developing roller 30 is provided with one area 30*a*, where the toner consumption is high, corresponding to $S_1$ and the other area 30*b*, where the toner consumption is low, corresponding to $S_2$. Also, in the toner receiving box 38, fresh toner exists in the region 38*a* which corresponds to the high toner consumption area 30*a* and, on the contrary, stationary toner exists in the region 38*b* which corresponds to the low toner consumption area 30*b*.

In the prior art system shown in FIG. 4, a running test was carried out for 500 printing sheets to obtain half-tone printed substances. As a result, it was found that there were black stripes and an increase of ODs (off-dots) in the area $S_2$ which corresponds to the area of low printing rate and, therefore, the quality of print was not good.

Figure 5:
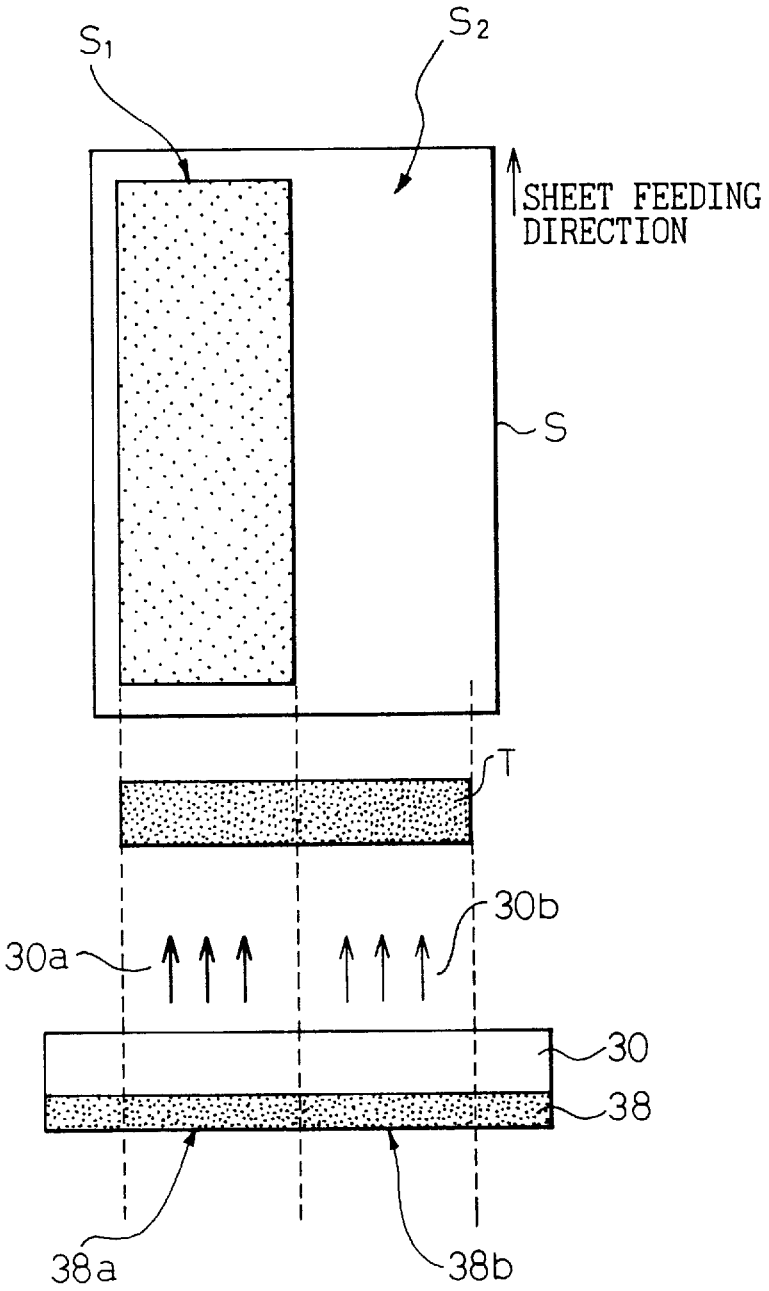
FIG. 5 is a plan view showing the relationship in position between the printing pattern and the stationary toner in this toner discharge system (Example 1)

An Example 1 of this invention will now be described. FIG. 5 shows the relationship in positions between the print pattern and the stationary toner (no stationary toner) on the photoconductor drum according to the toner discharge method of the present invention (Example 1). Regarding the area S ($S_1$, $S_2$) and 30 (30*a* and 30*b*), the conditions are the same as the case in the prior art as shown in FIG. 4. According to the present invention, in order to reduce the amount of stationary toner, a black toner T (all over) having a certain width is developed on the photoconductor drum at a controlled timing so as not to actually transfer the toner onto the printing sheet S.

That is to say, in the toner receiving box 38, a lot of fresh toner exists in the region 38*a* which corresponds to the high toner consumption area 30*a* and stationary toner exists in the region 38*b* which corresponds to the low toner consumption area 30*b*.

The all over uniform black toner T developed on the image carrying body (photoconductor drum) is scraped off the drum 20 by the cleaner 26 (FIG. 2) in the same manner as mentioned above and collected during the continuous printing operation by the toner recirculation mechanism 46.

Figure 6:
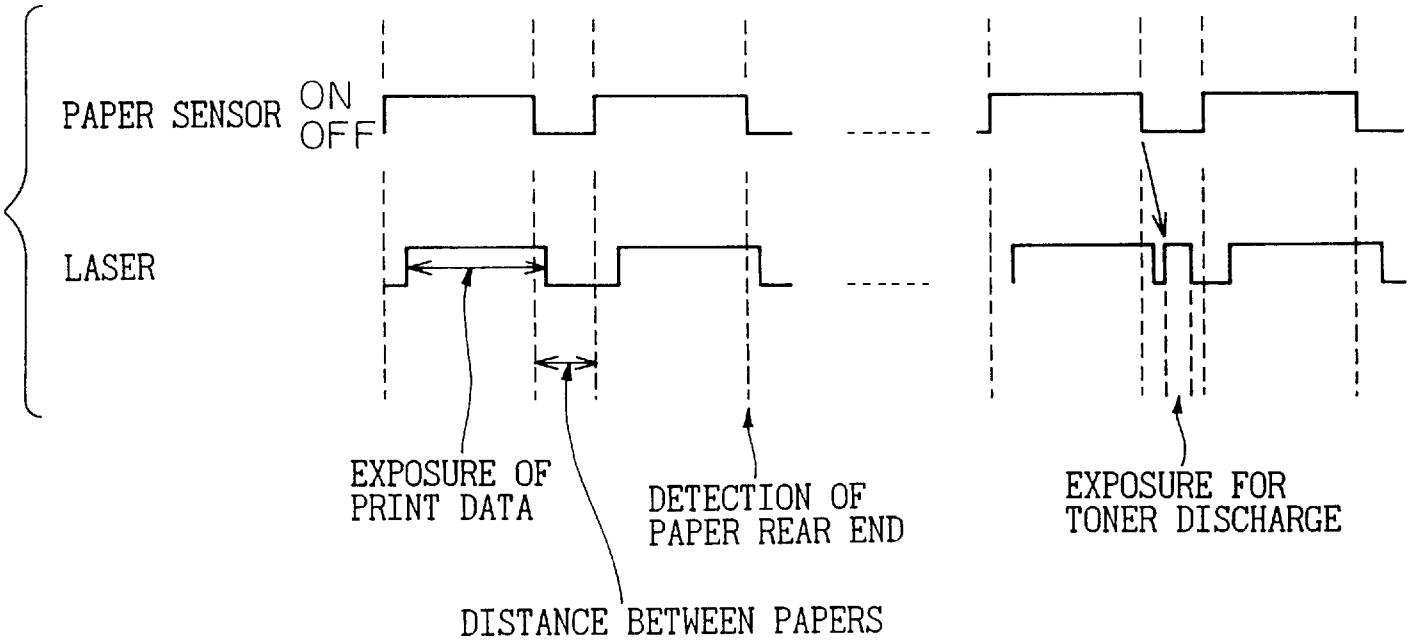
FIG. 6 is a timing chart according to Example 1.

Non-used toner for reducing the stationary toner is discharged from the development device 24 (FIG. 2) to the photoconductor drum 20. It is appreciated that such a toner discharge operation is carried out during the interval between adjacent printing sheets which is to be continuously printed. FIG. 6 shows a timing chart in this case. When the sheet is fed by the resist roller 58 (FIG. 1), the sheet sensor detects the trailing end of the sheet and is turned on. As shown in FIG. 6, every time when the recording sheets pass the sheet sensor, the sheet sensor repeats its on/off operations. The discharge of non-used toner is started at the time when the sheet sensor detects a trailing end of the sheet (down signal) after a predetermined number (such as, 500) of sheets is already printed. After a predetermined time period, a laser exposure is performed to form the latent image on the photoconductor drum and the latent image is developed with toner to form an all over black image (image of constant printing rate) T between the adjacent sheets as shown in FIG. 5.

The all over black image T is not transferred to the recording sheets, but collected by the cleaner 26 as mentioned above and then recirculated by the recirculation mechanism 46. Therefore, such a toner is not wasted. Since the non-used toner is thus periodically discharged from the development device 24 to the photoconductor drum 20, the deterioration of printing to the recording sheet with the used toner is effectively prevented.

The results of experimental data have also proved that such an operation can effectively prevent the printing deterioration with toner as follows.

(1) To reduce the amount of stationary toner, for one printing medium, an all-over black pattern having 20 mm width was developed in the sheet feeding direction on the latent image carrying body at a time not to transfer the toner onto the sheet and the non-used toner was collected. Such a running test was performed for 500 sheets. As the result, no black stripes were generated and no increase of ODs (off-dots) was found.

(2) To reduce the amount of stationary toner, for ten printing media, an all over black pattern having 200 mm width was developed in the sheet feeding direction on the latent image carrying body at a time not to transfer the toner onto the sheet and the non-used toner was collected. Such a running test was performed for 500 sheets. As the result, no black stripes were generated and no increase of OD was found.

(3) To reduce the amount of stationary toner, for 50 printing media, an all over black pattern having 200 mm width was developed in the sheet feeding direction on the latent image carrying body at a time not to transfer the toner onto the sheet and the non-used toner was collected. Such a running test was performed for 500 sheets. As the result, no black stripes were generated and no increase of OD was found.

An Example 2 of this invention will now be described.

Figure 7:
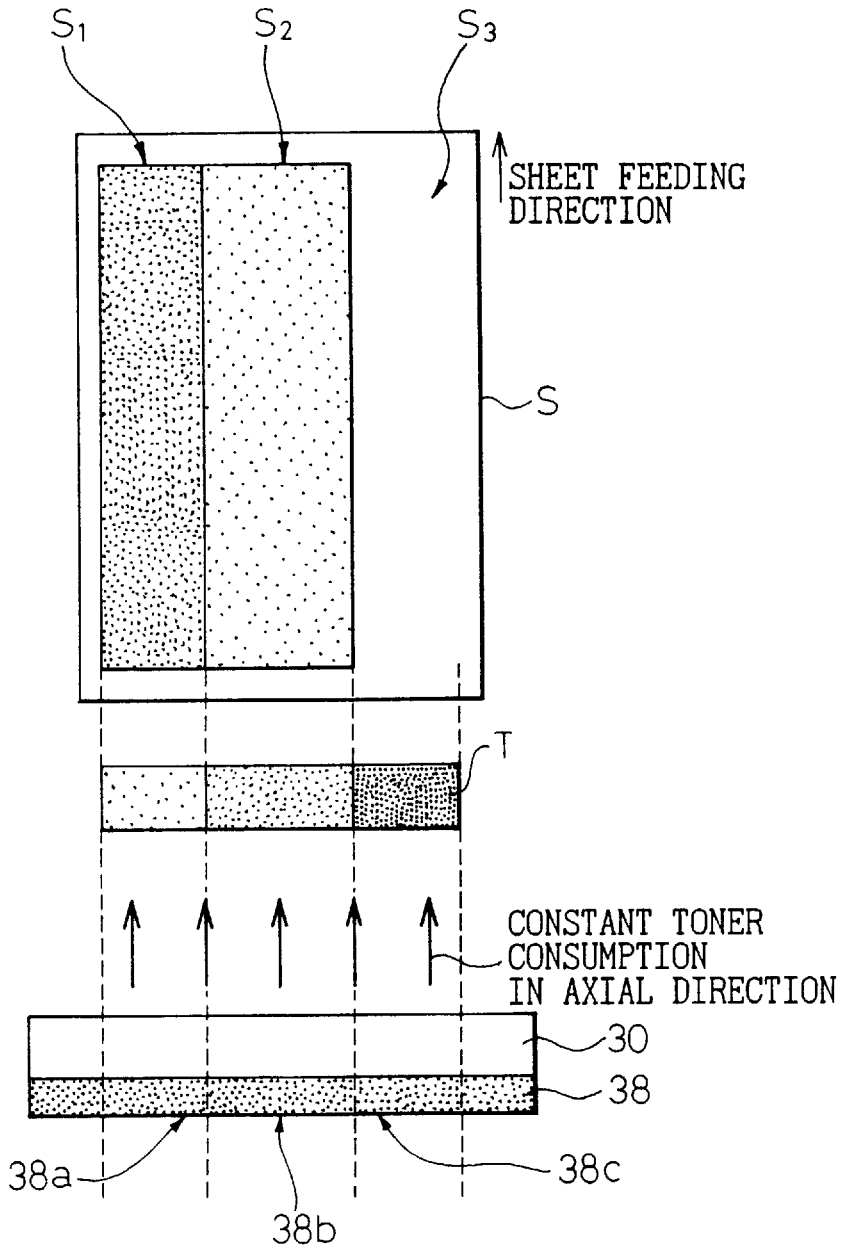
FIG. 7 is a plan view showing the relationship in position between the printing pattern and the stationary toner in this toner discharge system (Example 2)

FIG. 7 shows the relationship in positions between the print pattern and the stationary toner (no stationary toner) on the photoconductor drum according to the toner discharge method of the present invention (Example 2). $S_1$ on the recording sheet S represents an area of high rate of print, $S_2$ represents an area of middle rate of print and $S_3$ represents an area of low rate of print. In this example, however, the printing pattern for discharging the non-used toner is not all over black toner image having a certain width and a constant density, similar to the Example 1, but is a printing pattern T having the same amount of accumulated toner in the direction perpendicular to the sheet feeding direction by counting the number of dots as will be mentioned later.

Therefore, in the toner receiving box 38, with which the developing roller 30 is in contact, no stationary toner exists in any locations 38*a*–38*c*.

Thus, the Example 2 is the same as the Example 1 in the sense that the non-used toner is discharged at positions between adjacent printing sheets, but different from the Example 1 in the laser beam exposure method for discharging the non-used toner.

Figure 8:
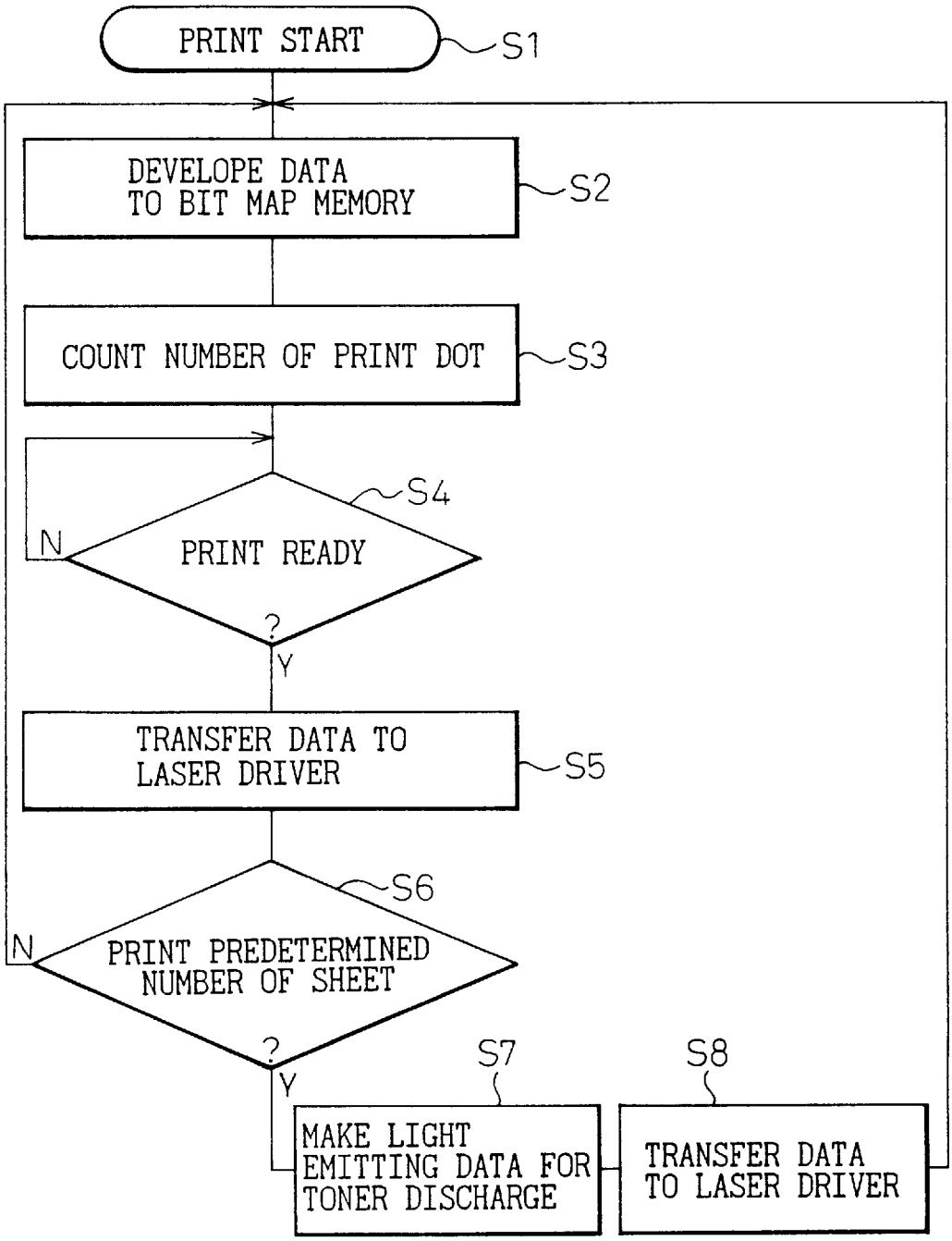
FIG. 8 is a block diagram for controlling the Example 2.
Figure 9:
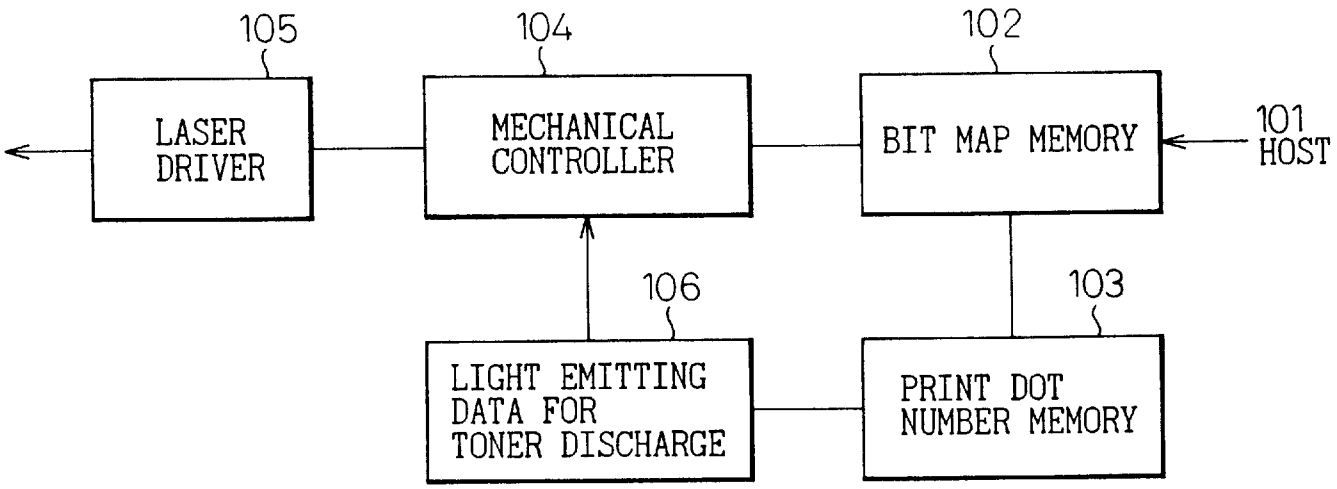
FIG. 9 is a timing chart of toner discharge steps according to Example 2.

FIG. 8 shows a control flow chart of the Example 2 and FIG. 9 shows a control block diagram thereof. A process for discharging non-used toner will now be described with reference to FIGS. 8 and 9.

After the printing operation is started (S1), the printing data transmitted from a host device 101 is first applied to the bit map memory 102 (S2). At the same time, the number of print dots is counted for the respective lines (in the recording sheet feeding direction) (S3) and stored in a print dot number memory section 103. When the printing operation is in its "ready" condition (S4), a mechanical controller 104 converts the data of the bit map memory 102 into "video" data and transfer them it a laser drive 105 (S5) so as to perform a laser exposure. When a printing operation for a predetermined number of printing sheets is completed (S6), the exposure data are prepared in a light emitting data section 106 for toner discharge (S7).

A method for preparing the exposure data will now be described. A maximum value M among the numbers of dots counted for the respective lines and count numbers L of the respective lines are determined. Exposure data, in which the number of printing dots (P) for the respective lines between adjacent sheets are (P=) M-L dots, are prepared and transferred to the laser drive 105 (S8). With the data thus prepared, the total number of printing dots for the respective lines is M. Therefore, the consumption of toner along the axial direction (perpendicular to the sheet feeding direction) is substantially constant and thus a generation of the non-used toner can be eliminated.

The experimental results according to the Example 2 will now be described below.

(1) To eliminate the amount of stationary toner, for one printing medium, an amount of non-used toner which is to be discharged was calculated in the hardware in such a manner that the accumulated toner consumption is substantially constant along the axial direction. The corresponding pattern was developed on the latent image carrying body at the timing not to transfer the toner onto the sheet and the non-used toner was collected. Such a running test was performed for 500 sheets. As the result, no black stripes were generated and no increase of ODs was found.

(2) To eliminate the amount of stationary toner, for ten printing media, an amount of non-used toner which is to be discharged was calculated in the hardware in such a manner that the accumulated toner consumption is substantially constant along the axial direction. The corresponding pattern was developed on the latent image carrying body at the timing not to transfer the toner onto the sheet and the non-used toner was collected. Such a running test was performed for 500 sheets. As the result, no black stripes were generated and no increase of OD was found.

(3) To eliminate the amount of stationary toner, for 50 printing media, an amount of non-used toner which is to be discharged was calculated in the hardware in such a manner that the accumulated toner consumption is substantially constant along the axial direction. The corresponding pattern was developed on the latent image carrying body at a time not to transfer the toner onto the sheet and the non-used toner was collected. Such a running test was performed for 500 sheets. As the result, no black stripes were generated and no increase of ODs was found.

Figure 10:
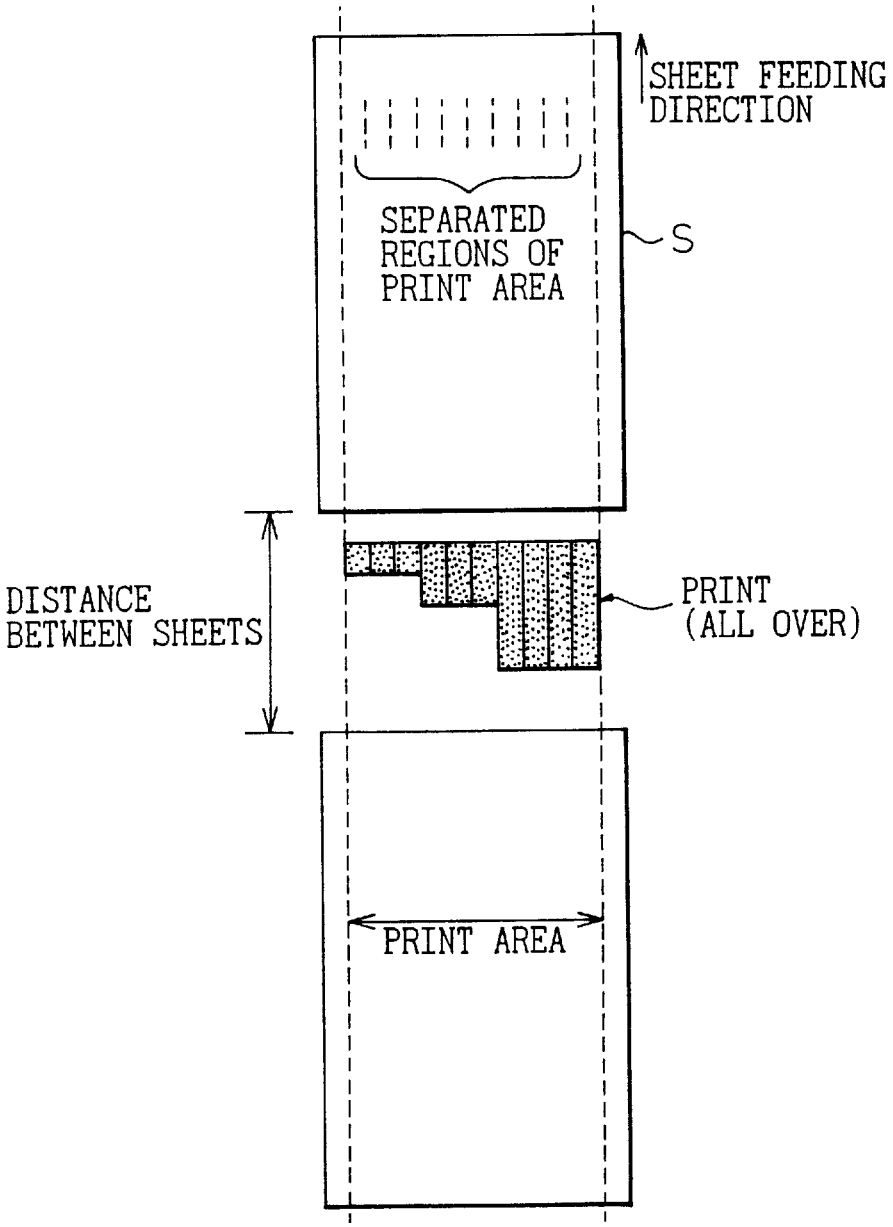
FIG. 10 is a view showing developing pattern (all over image) between sheets according to Example 3.
Figure 11:
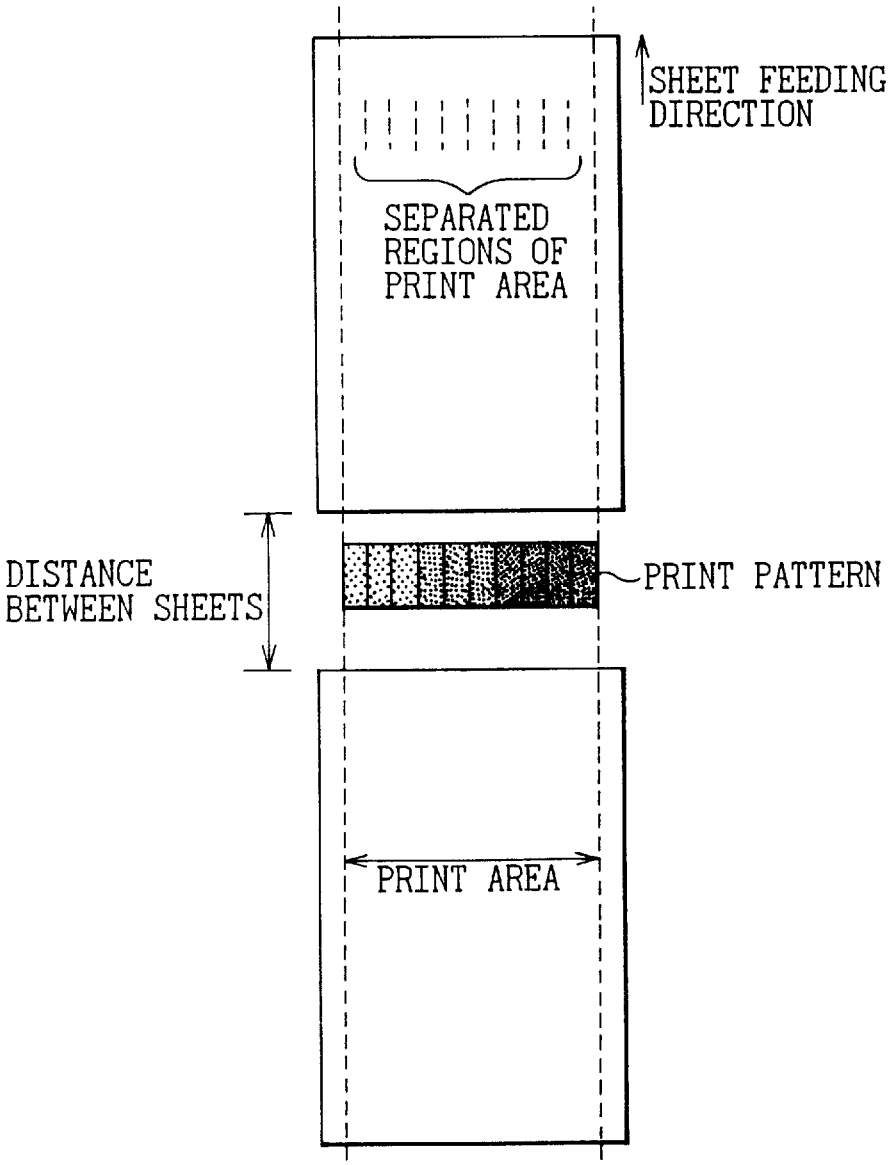
FIG. 11 is a view showing developing pattern (toner dark/light image) between sheets according to Example 4.

Examples 3 and 4 will now be described with reference to FIGS. 10 and 11.

The printing area S of the recording sheet was divided into a plurality of sections in the direction perpendicular to the sheet feeding direction (in the illustrated example, there were ten sections equidistantly divided). The numbers of printing dots for the respective sections were counted respectively and all over images (i.e. constant density images) having respective steps which are predetermined on the basis of the counted dot numbers are transferred to the photoconductor drum for the respective sections (Example 3). As shown in FIG. 10, the toner density of the all over images was constant, but the widths (i.e., the lengths in the sheet feeding direction) in the respective sections were different. It should be noted, however, that the maximum width is less than the distance between the adjacent sheets.

In the Example 4, the toner image is not an all over image having a constant density, but printing patterns having different densities (different printing rates) having a constant width for the respective sections. That is to say, in the same manner as the Example 3, the numbers of printing dots for the respective sections were counted respectively and all-over images having different toner densities which were predetermined on the basis of the counted dot numbers are transferred to the photoconductor drum for the respective sections within the distance between the adjacent sheets. Thus, generation of non-used toner in the development device can be reduced.

It should be understood by those skilled in the art that the foregoing description relates to only some preferred embodiments of the disclosed invention, and that various changes and modifications may be made to the invention without departing from the spirit and scope thereof. That is to say, the present invention can be applicable to improve the printing quality for any type of electrophotographic printers having an electrification unit, an exposure unit, a development device (two-component type having a certain amount of carrier), a transferring device, a cleaning device, and a toner recirculation device.

We claim:

1. An electrophotographic image forming apparatus comprising:

an electrostatic latent image carrying body;

an electrifying means for electrifying said image carrying body;

means for irradiating light onto said image carrying body to form an electrostatic latent image thereon in accordance to image information;

a developing unit, including a developing roller and a developer receiving box, for discharging toner to a first portion of said image carrying body so as to develop said latent image and to form a toner image thereon;

a transfer unit for transferring said toner image from said image carrying body to a recording medium;

means for conveying said recording medium through said transfer unit;

a cleaning means for removing residual toner on said image carrying body;

means for recirculating said toner removed from said image carrying body by said cleaning means to said developer receiving box; and a toner discharge unification means for discharging said toner by said developing roller to a second portion on said image carrying body based on toner usage in said first portion on said image carrying body, said second portion being located at a position other than the position of the first portion so as to develop said toner on said image carrying body, so that said toner is removed by said cleaning means without being transferred to said recording medium and recirculated from said image carrying body to said developer receiving box.

2. An apparatus as set forth in claim 1, wherein said recording medium is a cut sheet and said second portion corresponds to a non-transfer area which is defined between adjacent cut sheets, so that, after a predetermined number of cut sheets are printed, said toner discharge unification means discharges toner by said developing roller at said non-transfer area on said image carrying body.

3. An apparatus as set forth in claim 1, wherein said toner discharge by said developing roller to said image carrying body is performed uniformly by a predetermined amount in a direction perpendicular to a conveying direction of said recording medium.

4. An apparatus as set forth in claim 1, wherein said toner discharge by said developing roller to said image carrying body is performed in such a manner that a total amount of toner, including the toner discharged in accordance with said image information, is substantially constant both in a recording medium conveying direction and in a direction perpendicular thereto.

5. An apparatus as set forth in claim 1, wherein a printing area on said image carrying body is divided into several sections in a direction perpendicular to a recording medium conveying direction and said toner discharge by said developing roller to said image carrying body is performed in such a manner that print dot numbers of the respective sections are counted in accordance with said image information and an amount of toner, which is to be discharged, is determined for the respective sections based on said print dot numbers.

6. An apparatus as set forth in claim 1, wherein a printing area on said image carrying body is divided into several sections in a direction perpendicular to a recording medium conveying direction and said toner discharge by said developing roller to said image carrying body is performed in such a manner that a same toner pattern is developed in said respective sections along the recording medium conveying direction.

7. An apparatus as set forth in claim 1, wherein a printing area on said image carrying body is divided into several sections in a direction perpendicular to a recording medium conveying direction and said toner discharge by said developing roller to said image carrying body is performed in such a manner that print dot numbers of the respective sections are counted in accordance with said image information and a same toner pattern, but having a different length in said recording medium conveying direction based on said print dot number, is developed for said respective sections.

8. An apparatus as set forth in claim 1, wherein a printing area on said image carrying body is divided into several sections in a direction perpendicular to a recording medium conveying direction and said toner discharge by said developing roller to said image carrying body is performed in such a manner that print dot numbers of the respective sections are counted in accordance with said image information and a toner having different printing rate based on said print dot number, is developed for said respective sections.

9. An apparatus as set forth in claim 5, wherein an amount of toner, which is to be discharged, is determined for the respective sections based on said print dot numbers.

10. An electrophotographic image forming apparatus comprising:

an electrostatic latent image carrying body;

an electrifying means for electrifying said image carrying body;

means for irradiating light onto said image carrying body to form a first electrostatic latent image thereon in accordance with first image information;

means for irradiating light onto said image carrying body to form a second electrostatic latent image thereon in accordance with second image information;

a developing unit, including a developing roller and a developer receiving box, for discharging toner to said image carrying body so as to develop said first and second latent images and to form first and second toner images thereon;

a transfer unit for transferring said first toner image from said image carrying body to a recording medium;

means for conveying said recording medium through said transfer unit;

a cleaning means for removing residual toner of said first toner image and toner of said second toner image from said image carrying body;

means for recirculating said toner removed from said image carrying body to said cleaning means to said developer receiving box; and means for controlling, not to transfer said second toner image to said recording medium, but to form said second toner image on a position on said image carrying body corresponding to a non-transfer area, or an area defined between adjacent recording mediums, based on toner usage in said first toner image.

11. An apparatus as set forth in claim 10, wherein said recording medium is a cut sheet and said non-transfer area is defined between adjacent cut sheets, so that, after a predetermined number of cut sheets are printed, said second toner image is formed on a position on said image carrying body corresponding to said non-transfer area.

12. An apparatus as set forth in claim 10, wherein said second toner image is formed so as to extend with a predetermined width in a direction perpendicular to a conveying direction of said recording medium.

13. An apparatus as set forth in claim 10, wherein said second toner image is formed in such a manner that a total amount of toner, including said first toner image, is substantially constant both in a recording medium conveying direction and in a direction perpendicular thereto.

14. An apparatus as set forth in claim 10, wherein said second toner image is an all-over image having a constant print rate.

15. An apparatus as set forth in claim 14, wherein a printing area on said image carrying body is divided into several sections along a direction perpendicular to a recording medium conveying direction, print dot numbers of the respective sections are counted in accordance with said first image information, so that an area of said all over image of said second toner image is determined for the respective sections based on said print dot number.

16. An apparatus as set forth in claim 10, wherein said second toner image comprises image patterns having different printing rates within said non-transfer area.

17. An apparatus as set forth in claim 16, wherein a printing area on said image carrying body is divided into several sections along a direction perpendicular to a recording medium conveying direction, and print dot numbers of the respective sections are counted in accordance with said first image information, so that the printing rates of the image patterns of said second toner image is determined for the respective sections based on said print dot number.

* * * * *